US006834852B2

(12) United States Patent
Smith et al.

(10) Patent No.: US 6,834,852 B2
(45) Date of Patent: Dec. 28, 2004

(54) PRINTER EXIT TRAY AND COMPUTER PRINTER HAVING AN EXIT TRAY

(75) Inventors: Herman Anthony Smith, Winchester, KY (US); Donald Norman Spitz, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/666,637

(22) Filed: Sep. 18, 2003

(65) Prior Publication Data

US 2004/0081505 A1 Apr. 29, 2004

Related U.S. Application Data

(63) Continuation of application No. 09/927,636, filed on Aug. 10, 2001, now Pat. No. 6,659,454.

(51) Int. Cl.[7] ..... B65H 31/24

(52) U.S. Cl. ..... 271/213; 271/207; 400/625; 347/102; 347/104

(58) Field of Search ..... 271/220, 207, 271/213, 218; 400/625; 347/104, 102; 399/405

(56) References Cited

U.S. PATENT DOCUMENTS 4,794,859 A * 1/1989 Huseby et al. ..... 101/485
5,709,382 A * 1/1998 Shima ..... 271/209
5,745,141 A * 4/1998 Miyawaki ..... 347/104
6,027,269 A * 2/2000 Yoshida ..... 400/625
6,089,772 A * 7/2000 Takemura et al. ..... 400/625
6,092,948 A * 7/2000 Altfather ..... 400/625
6,164,206 A * 12/2000 Yoshida ..... 101/484
6,238,114 B1 * 5/2001 Bennett et al. ..... 400/625
6,659,454 B1 * 12/2003 Smith et al. ..... 271/213

* cited by examiner

*Primary Examiner*—Donald P. Walsh
*Assistant Examiner*—Matthew J. Kohner
(74) *Attorney, Agent, or Firm*—Thompson Hine, LLP

(57) ABSTRACT

A printer exit tray assembly attachable to a printer housing and a computer printer including a printed paper exit tray assembly. The exit tray assembly has an exit tray and a pair of sheet supports attached to the exit tray. The exit tray is movable between a use position and a collapsed position. The exit tray is positioned generally horizontally in the use position. The exit tray projects horizontally further from the printer housing in the use position than in the collapsed position. When the exit tray is in the use position the supports are pivotable, with respect to the exit tray, between a support position for supporting a printed sheet above the exit tray and a release position for releasing the printed sheet to the exit tray.

12 Claims, 11 Drawing Sheets

PRINTER EXIT TRAY AND COMPUTER PRINTER HAVING AN EXIT TRAY

CROSS REFERENCE TO RELATED APPLICATIONS

The present application is a continuation application of U.S. application Ser. No. 09/927,636 filed Aug. 10, 2001 now U.S. Pat. No. 6,659,454.

TECHNICAL FIELD

The present invention relates generally to printers, and more particularly to a printer exit tray and a computer printer having an exit tray.

BACKGROUND OF THE INVENTION

Printers, such as computer printers, have exit trays which hold printed sheets as the printed sheets exit the printed paper outlet of the printer. Horizontal exit trays collect printed sheets which exit from horizontal printed paper outlets. Some horizontal exit trays are passive in that they serve merely as receptacles for the printed sheets. Retractable passive exit trays are known which can be moved within or under the printer housing to free up valuable desk space when the passive exit tray is not in use. Other horizontal exit trays are active in that they first support a printed sheet above the exit tray bottom to allow the ink to dry on the previously printed sheet and then allow the supported printed sheet to fall towards the exit tray bottom.

What is needed is a more convenient active printer exit tray and a computer printer having a more convenient active exit tray.

SUMMARY OF THE INVENTION

A first expression of the invention is for a computer printer having a housing and having a printed paper exit tray assembly. The housing has a generally horizontal printed paper outlet. The printed paper exit tray assembly is positioned adjacent to the paper outlet of the housing. The printed paper exit tray assembly includes a generally horizontal exit tray positioned below the paper outlet and includes a pair of opposed pivotable sheet supports positioned vertically between the paper outlet and the exit tray and extending generally along longitudinal sides of the exit tray. The supports are pivotable from a support position to a release position. The support position is a position in which an upper support surface of each support is positioned directly below a respective horizontal end portion of the paper outlet. The release position is a position in which the upper support surface of each support is pivoted outwardly away from the respective horizontal end portion of the paper outlet. The supports are operative in their support position to support printed sheets emitted from the paper outlet above the exit tray and operative in their release position to drop the printed sheets to the exit tray. The printed paper exit tray assembly is collapsible with respect to the housing.

A second expression of the invention is for a printer exit tray assembly having a printed-sheet exit tray and having a pair of opposed sheet supports attached to the exit tray. The exit tray is attachable to a printer housing. When the exit tray is attached to the printer housing, the exit tray is movable between a use position and a collapsed position. The exit tray is positioned generally horizontally in the use position. The exit tray projects horizontally further from the printer housing in the use position than in the collapsed position. When the exit tray is in the use position the supports are pivotable, with respect to the exit tray, between a support position for supporting a printed sheet above the exit tray and a release position for releasing the printed sheet to the exit tray.

Several benefits and advantages are derived from the invention. The supports hold a printed page or printed sheet above the exit tray to allow time for the ink to dry on the previously printed page or sheet lying on top in the exit tray. The collapsible exit tray assembly, or at least the collapsible exit tray portion thereof, frees up valuable desk space when the exit tray assembly is not in use and reduces packaging requirements for shipping.

DETAILED DESCRIPTION

Figure 1:
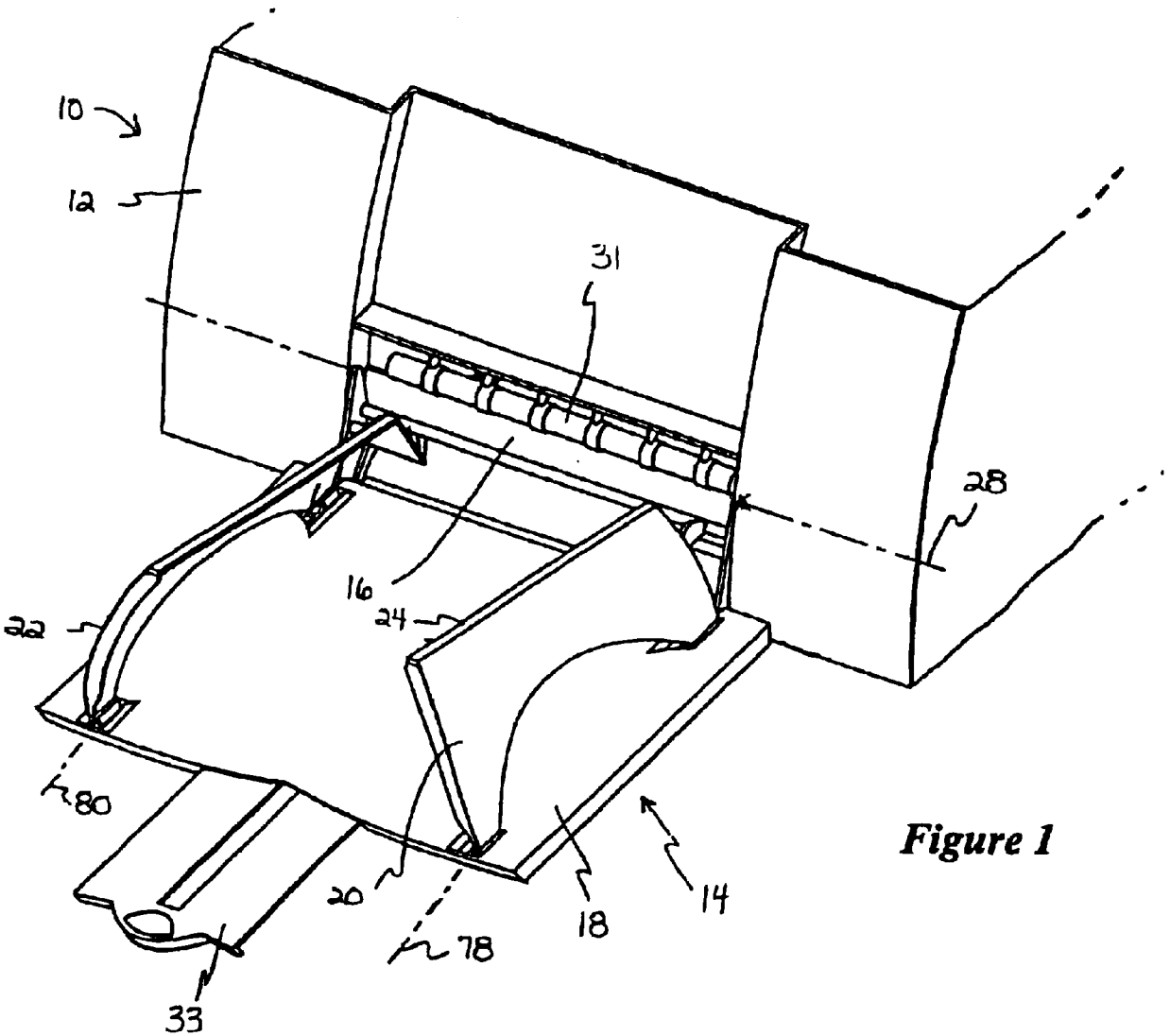
FIG. 1 is a perspective view of a first embodiment of the invention showing a portion of a computer printer housing including a horizontal printed paper outlet together with a printed paper exit tray assembly.
Figure 2:
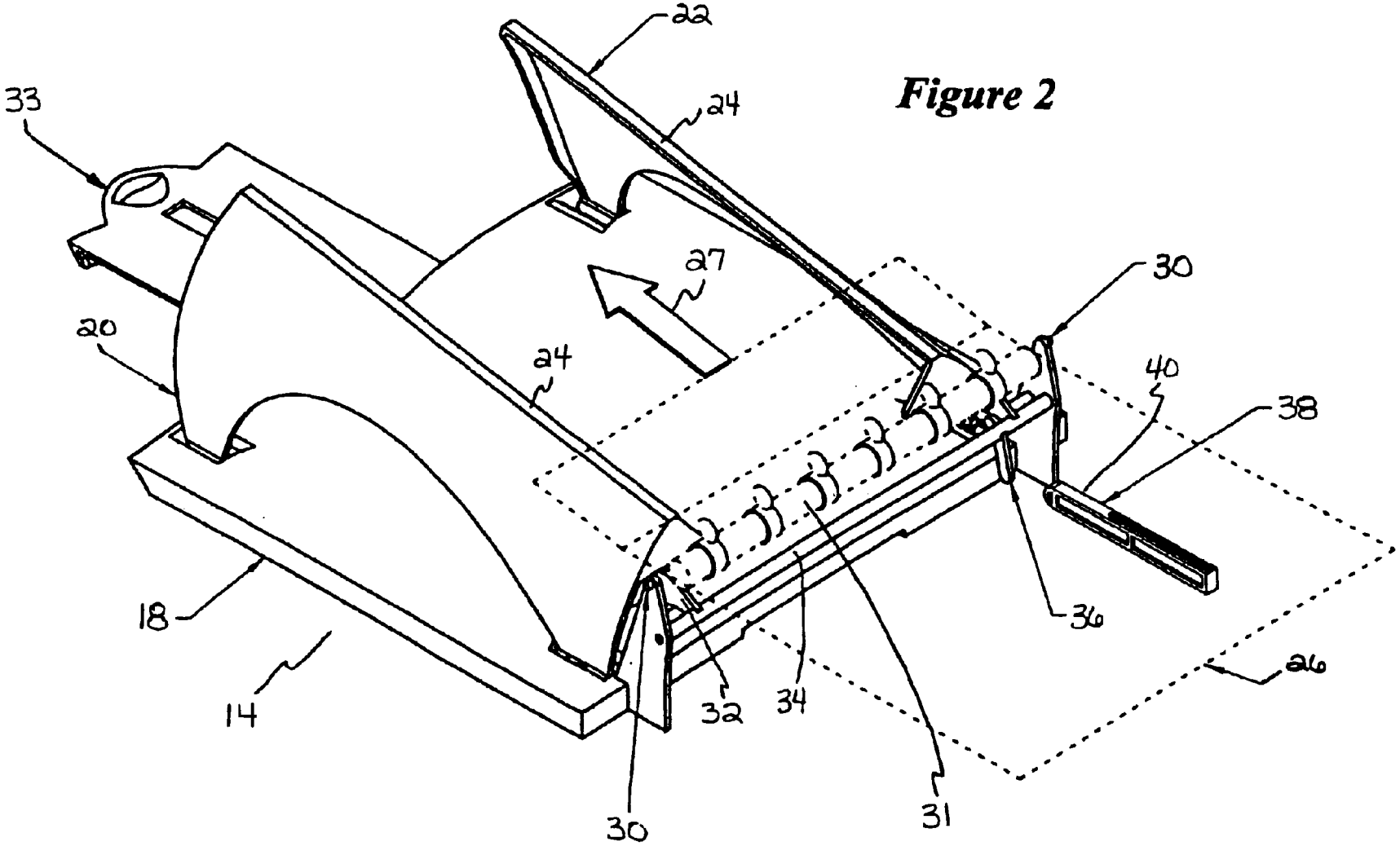
FIG. 2 is a perspective view of the exit tray assembly of FIG. 1 with the supports in the support position supporting a printed paper sheet above the exit tray.
Figure 3:
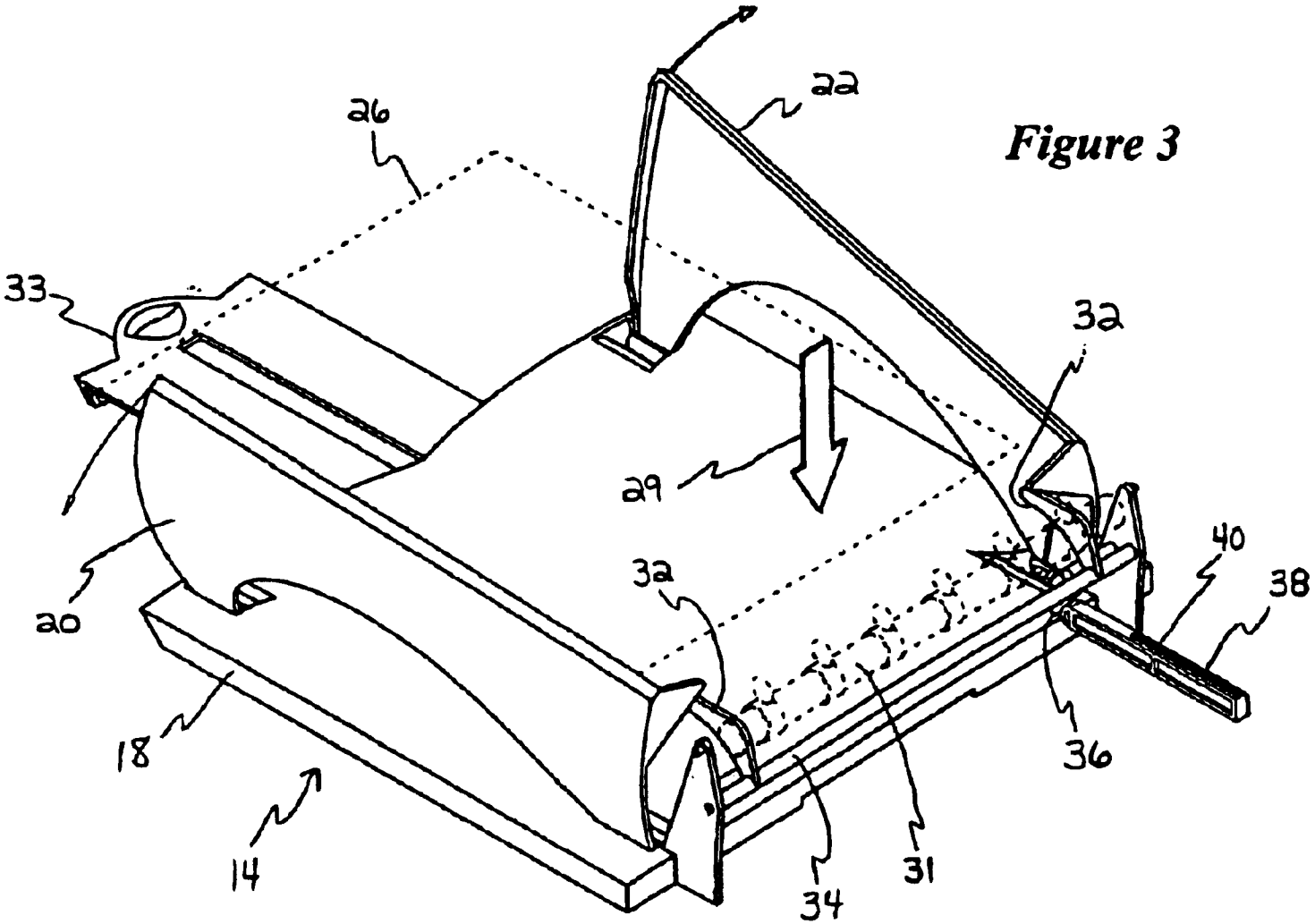
FIG. 3 is a perspective view of the exit tray assembly of FIG. 1 with the supports in the release position dropping a printed paper sheet into the exit tray.

A first embodiment of the invention is shown in FIGS. 1–6. In a first expression of the first embodiment, a computer printer 10 includes a housing (or printer housing) 12 and a printed paper (or printed sheet) exit tray assembly 14. The housing 12 has a generally horizontal printed paper (or printed sheet) outlet 16. The exit tray assembly 14 is positioned adjacent to the paper outlet 16 of the housing 12. The printed paper exit tray assembly 14 includes a generally horizontal exit tray 18 positioned below the paper outlet 16. The printed paper exit tray assembly 14 also includes a pair of opposed pivotable sheet supports 20 and 22 positioned vertically between the paper outlet 16 and the exit tray 18 and extending generally along longitudinal sides of the exit tray 18. The supports 20 and 22 are pivotable from a support position (seen in FIG. 2) to a release position (seen in FIG. 3). The support position is a position in which an upper support surface 24 of each support 20 and 22 is positioned directly below a respective horizontal end portion of the paper outlet 16 (seen in FIG. 1). The release position is a position in which the upper support surface 24 of each support 20 and 22 is pivoted outwardly away from the respective horizontal end portion of the paper outlet 16. The supports 20 and 22 are operative in their support position to support printed sheets 26 (shown in dashed line in FIG. 2) emitted from the paper outlet 16 above the exit tray 18. The supports 20 and 22 are operative in their release position to drop the printed sheets 26 (shown in dashed line in FIG. 3) to the exit tray 18. The printed paper exit tray assembly 14 is collapsible with respect to the housing 12.

Arrow 27 indicates the direction the printed sheet 26 exits from the paper outlet 16, and arrow 29 indicates the direction the printed sheet 26 is dropped to the exit tray 18. In one construction, a printer exit roll 31 discharges the printed sheet 26 from the paper outlet 16.

Figure 8:
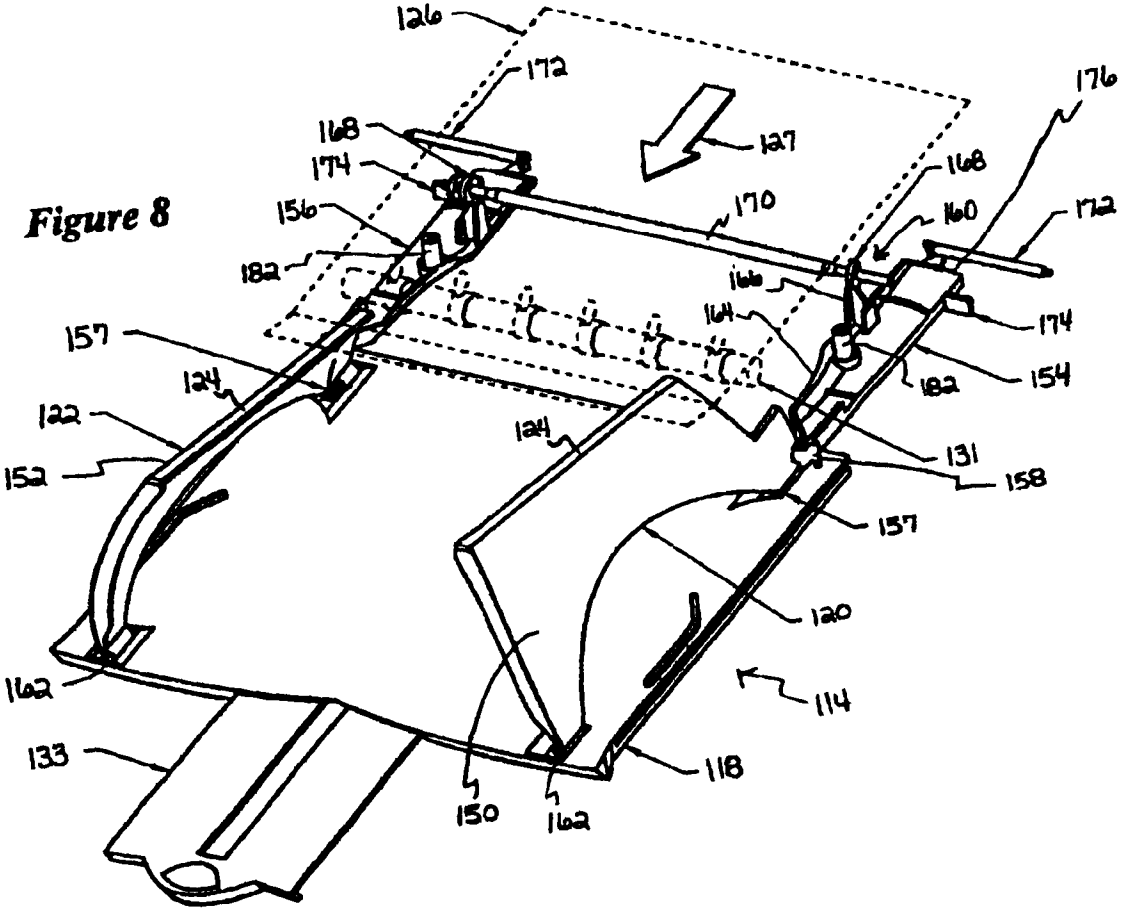
FIG. 8 is a perspective view of the exit tray assembly of FIG. 7 with the supports in the support position supporting a printed paper sheet above the exit tray.
Figure 9:
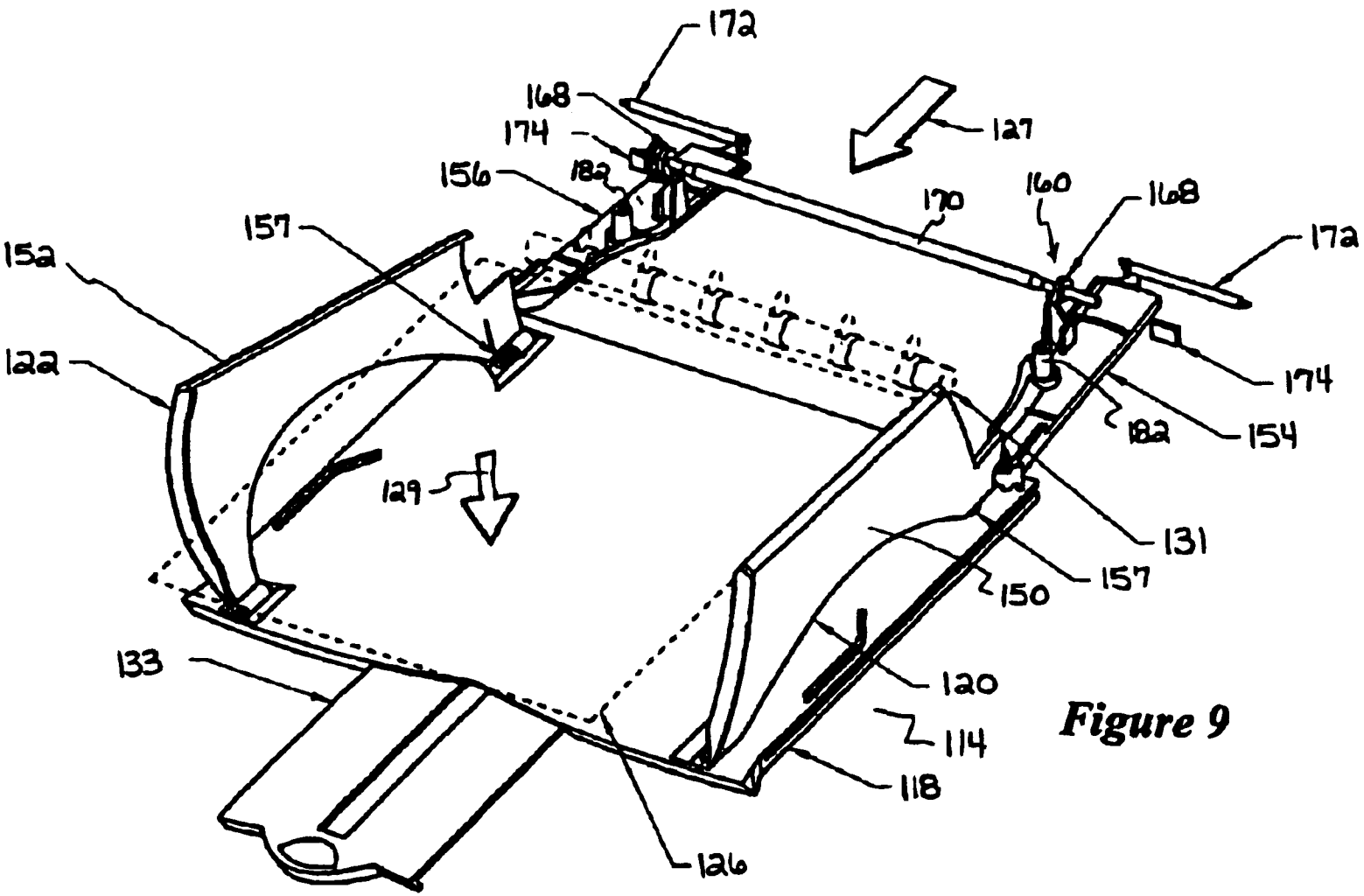
FIG. 9 is a perspective view of the exit tray assembly of FIG. 7 with the supports in the release position dropping a printed paper sheet into the exit tray.

In one example, the exit tray 18 is pivotably coupled to the housing 12, whereby the printed paper exit tray assembly 14 collapses with respect to the housing 12 by pivoting (about pivot axis 28 seen in FIGS. 1 and 8) at least the exit tray 18 up to a generally vertical orientation adjacent the housing 12. In one construction, pivot pins 30 (defining the pivot axis 28) on the printed paper exit tray assembly 14 engage pivot holes (not shown) in the housing 12. FIG. 8 shows the printed paper exit tray assembly 14*a* in its use position and shows the printed paper exit tray assembly 14*b* in its collapsed position with at least the exit tray 18 pivoted up to a generally vertical orientation. In one construction, the exit tray 18 includes a retractable tray extension 33.

Figure 4:
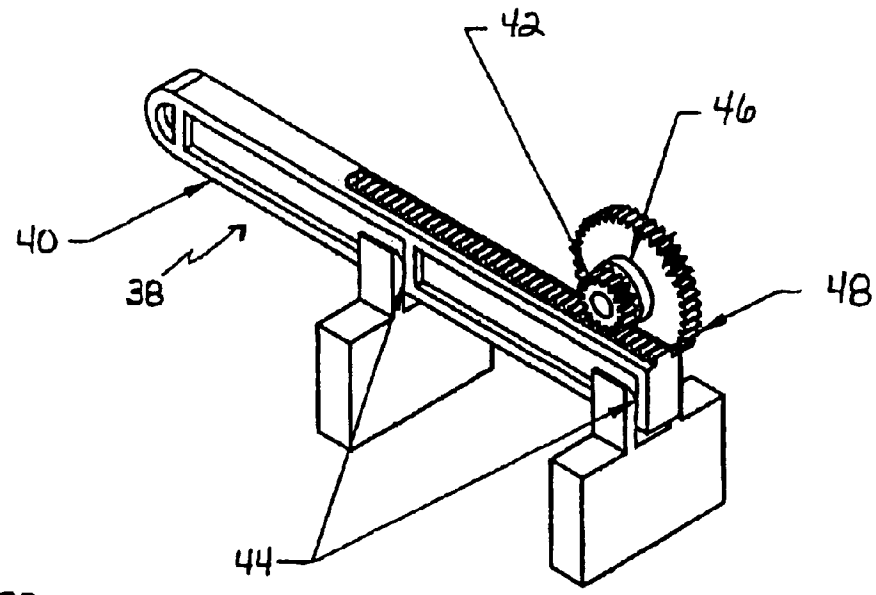
FIG. 4 is an enlarged view of the rack shown in its extended position in FIG. 3.
Figure 5:
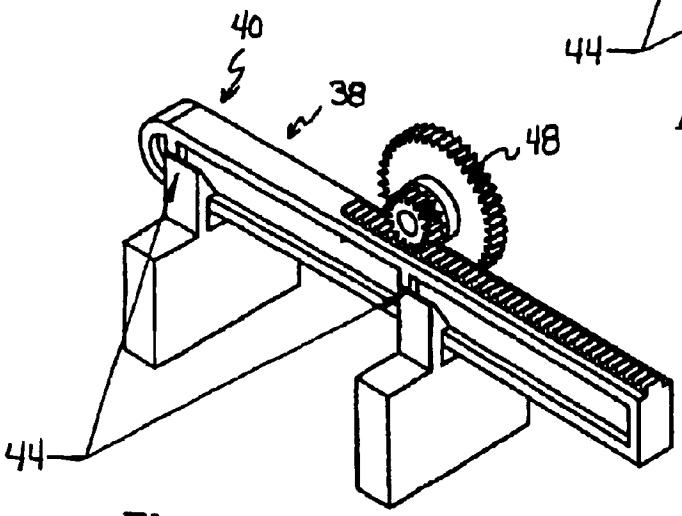
FIG. 5 is an enlarged view of the rack shown in its withdrawn position in FIG. 2.
Figure 6:
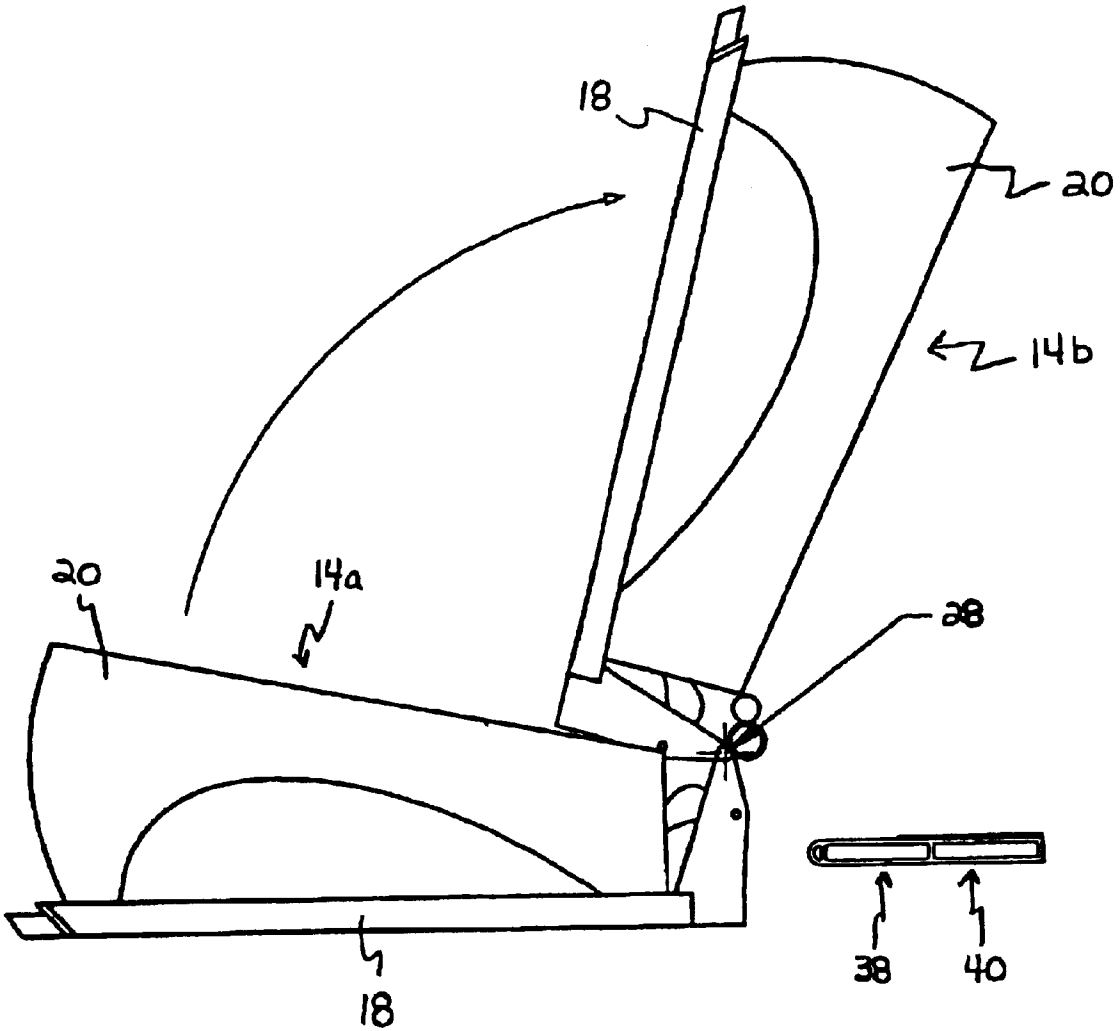
FIG. 6 is an operational side elevational view of the exit tray assembly of FIG. 1 shown in both the use and collapsed positions.
Figure 7:
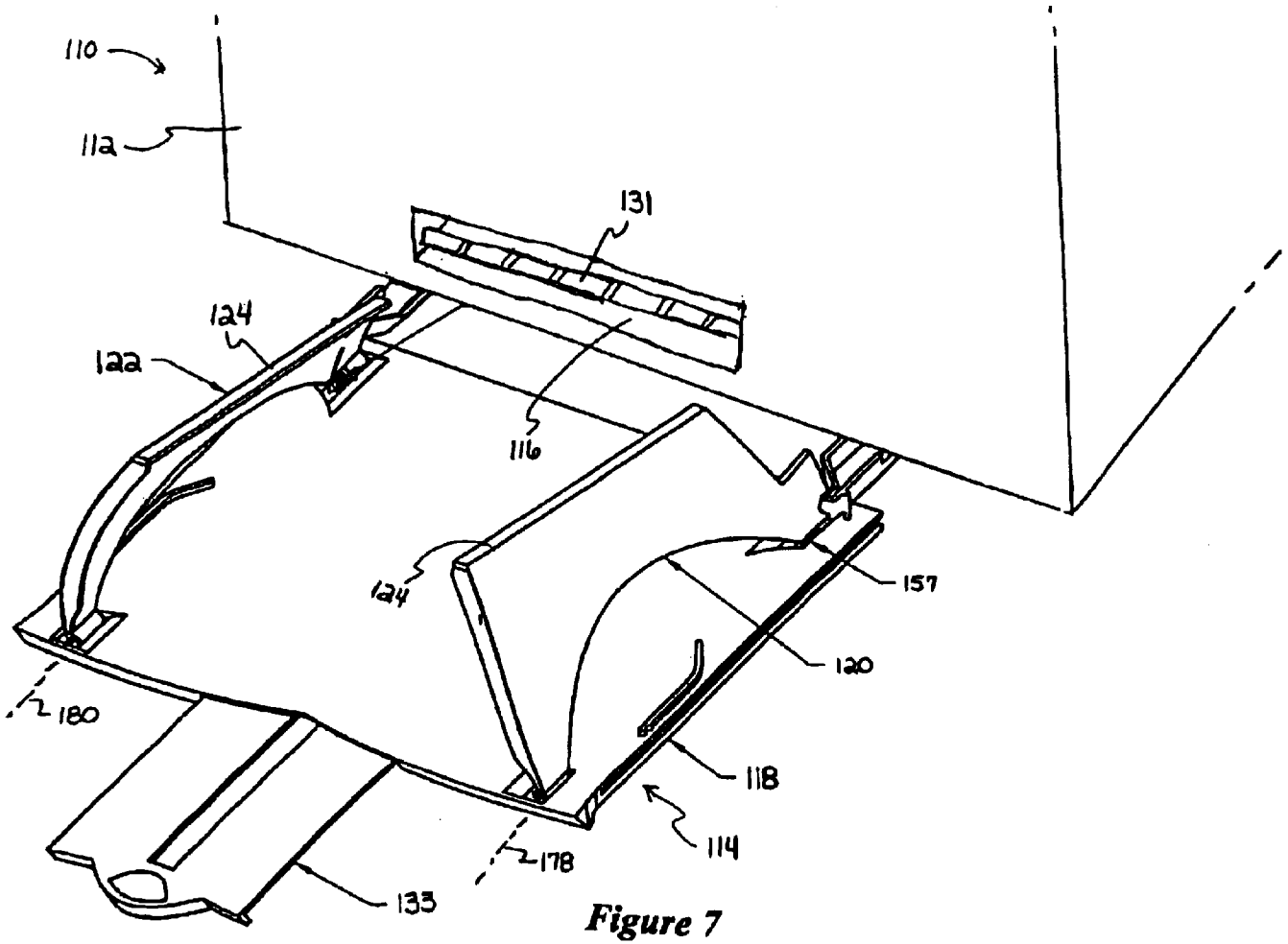
FIG. 7 is a perspective view of a second embodiment of the invention showing a portion of a computer printer housing including a horizontal printed paper outlet together with a printed paper exit tray assembly.

In another example, each of the supports 20 and 22 are actuated by a respective cam 32 carried on a cam shaft 34. The cam shaft 34 further includes an actuator projection 36 extending radially therefrom. The actuator projection 36 is acted upon by a reciprocating arm 38 which extends from the housing 12. An outward extension of the reciprocating arm 38 contacts and presses against a radially outer portion of the actuator projection 36. This causes the cam shaft 34 and cams 32 to rotate, and, in turn, causing the cams 32 to actuate their respective supports 20 and 22 as shown in FIGS. 4 and 5. In one construction, the reciprocating arm 38 is a rack 40 engaged with a pinion 42 (seen in FIGS. 4 and 5) coupled to the housing 12.

In one design, the computer printer 10 further includes a pair of stops 44, respectively stopping the forward and rearward travel of the reciprocating arm 38 at respective actuating and retracted positions, respectively. In one modification, a clutch 46 is operatively coupled between the pinion 42 engaged with the rack 40 and a drive (such as drive gear 48) for rotatably driving the pinion 42. In one variation, the clutch 46 is a friction clutch coaxially pressed between the pinion 42 and the drive gear 48. When the rack 40 drives completely forward, it hits the front hard stops and then the clutch slips. When the rack 40 drives completely backwards, it hits the rear hard stops and the clutch slips again. This allows the rack 40 to be driven home and reset when paper is printed and exiting the printer. The rack 40 and actuator projection 36 design allows the actuator projection 36 to re-engage with the rack 40 for any position of the actuator projection 36. In one variation, a toggle gear/sector gear combination (not shown) is used in place of the slipping friction clutch mechanism.

In a second expression of the first embodiment, a printer exit tray assembly 14 includes a printed-sheet exit tray 18 and a pair of opposed sheet supports 20 and 22. The exit tray 18 is attachable to a printer housing 12. When the exit tray 18 is attached to the printer housing 12, the exit tray 18 is movable between a use position and a collapsed position. The exit tray 18 is disposed generally horizontally in the use position. The exit tray 18 projects horizontally further from the printer housing 12 in the use position than in the collapsed position. The sheet supports 20 and 22 are attached to the exit tray 18. When the exit tray 18 is in the use position the supports 20 and 22 are pivotable, with respect to the exit tray 18, between a support position for supporting a printed sheet 26 above the exit tray 18 and a release position for releasing the printed sheet 26 to the exit tray 18.

Another expression of the first embodiment is a combination computer printer 10 and active exit-tray support assembly 14 for the computer printer 10 and includes a printer housing 12, a generally horizontal exit tray 18, and a pair of opposed support wings 20 and 22. The exit tray 18 is coupled to the housing 12 and is pivotal between a generally horizontal orientation projecting away from the housing 12 and a generally vertical orientation adjacent the housing 12. The support wings 20 and 22 are pivotally coupled to the exit tray 18 on a longitudinal edge of each support wing 20 and 22 on a pivot axis 78 and 80 that runs generally parallel to a horizontal plane of the exit tray 18 and extending generally along opposite longitudinal sides of the exit tray 18. Each support wing 20 and 22 is pivotable from a generally vertical printed page support position to a generally outwardly angled printed page release position. Each of the support wings 20 and 22 is actuated by a respective cam 32 carried on a cam shaft 34. The cam shaft 34 further includes an actuator projection 36 extending radially therefrom. The actuator projection 36 is acted upon by a reciprocating arm 38 extending from the housing 12. An outward extension of the reciprocating arm 38 contacts and presses against a radially outer portion of the actuator projection 36 causing the cam shaft 34 and cams 32 to rotate, and, in turn, causing the cams 32 to actuate their respective support wings 20 and 22. In one design, the reciprocating arm 38 is a rack 40 engaged with a pinion 42 coupled to the printer housing 12.

A second embodiment of the invention is shown in FIGS. 7–12 In a first expression of the second embodiment, a computer printer 110 includes a housing (or printer housing) 112 and a printed paper (or printed sheet) exit tray assembly 114. The housing 112 has a generally horizontal printed paper (or printed sheet) outlet 116. The exit tray assembly 114 is positioned adjacent to the paper outlet 116 of the housing 112. The printed paper exit tray assembly 114 includes a generally horizontal exit tray 118 positioned below the paper outlet 116. The printed paper exit tray assembly 114 also includes a pair of opposed pivotable sheet supports 120 and 122 positioned vertically between the paper outlet 116 and the exit tray 118 and extending generally along longitudinal sides of the exit tray 118. The supports 120 and 122 are pivotable from a support position (seen in FIG. 8) to a release position (seen in FIG. 9). The support position is a position in which an upper support surface 124 of each support 120 and 122 is positioned directly below a respective horizontal end portion of the paper outlet 16 (seen in FIG. 7). The release position is a position in which the upper support surface 124 of each support 120 and 122 is pivoted outwardly away from the respective horizontal end portion of the paper outlet 116. The supports 120 and 122 are operative in their support position to support printed sheets 126 (shown in dashed line in FIG. 8) emitted from the paper outlet 116 above the exit tray 118. The supports 120 and 122 are operative in their release position to drop the printed sheets 126 (shown in dashed line in FIG. 9) to the exit tray 118. The printed paper exit tray assembly 114 is collapsible with respect to the housing 112.

Arrow 127 indicates the direction the printed sheet 126 exits from the paper outlet 116, and arrow 129 indicates the direction the printed sheet 126 is dropped to the exit tray 118. In one construction, a printer exit roll 131 discharges the printed sheet 126 from the paper outlet 116.

In one example, the exit tray 118 is slidably mounted to a lower surface of the housing 112 and is slidable to a collapsed position wherein the exit tray 118 resides at least partially under the housing 112. In one construction, the exit tray 118 includes a retractable tray extension 133.

In another example, the supports 120 and 122 are pivotally coupled to the exit tray 118 and are pivotable inwardly beyond the support position to a folded position, wherein the supports 120 and 122 are slidable with the exit tray 118 in the collapsed position to reside at least partially under the housing 112. In one design, the supports 120 and 122 are generally planar wings (or support wings) 150 and 152 and the wings 150 and 152 are generally parallel to the exit tray 118 in their folded position.

Figure 10:
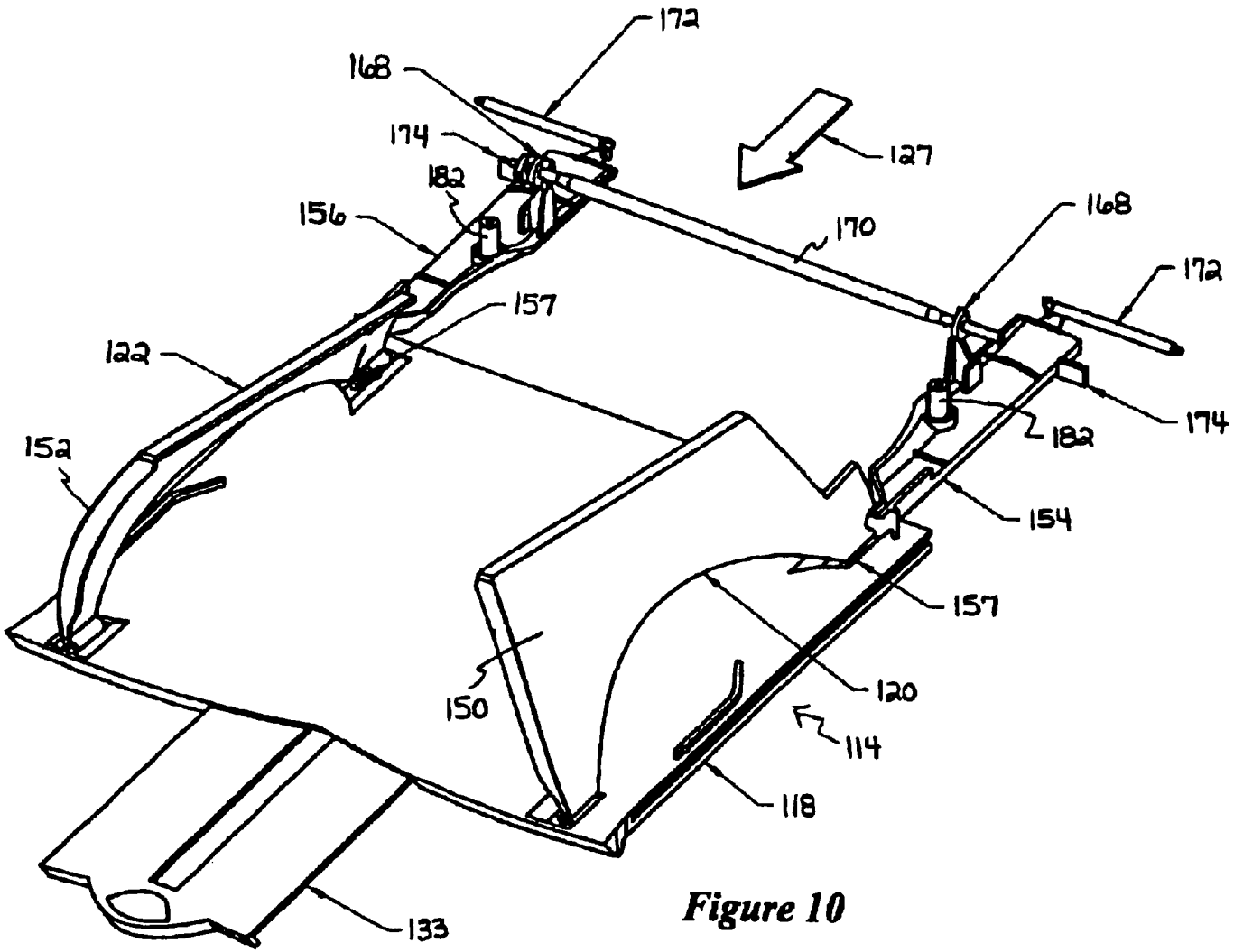
FIG. 10 is a perspective view of the exit tray assembly of FIG. 7 in the use position.
Figure 11:
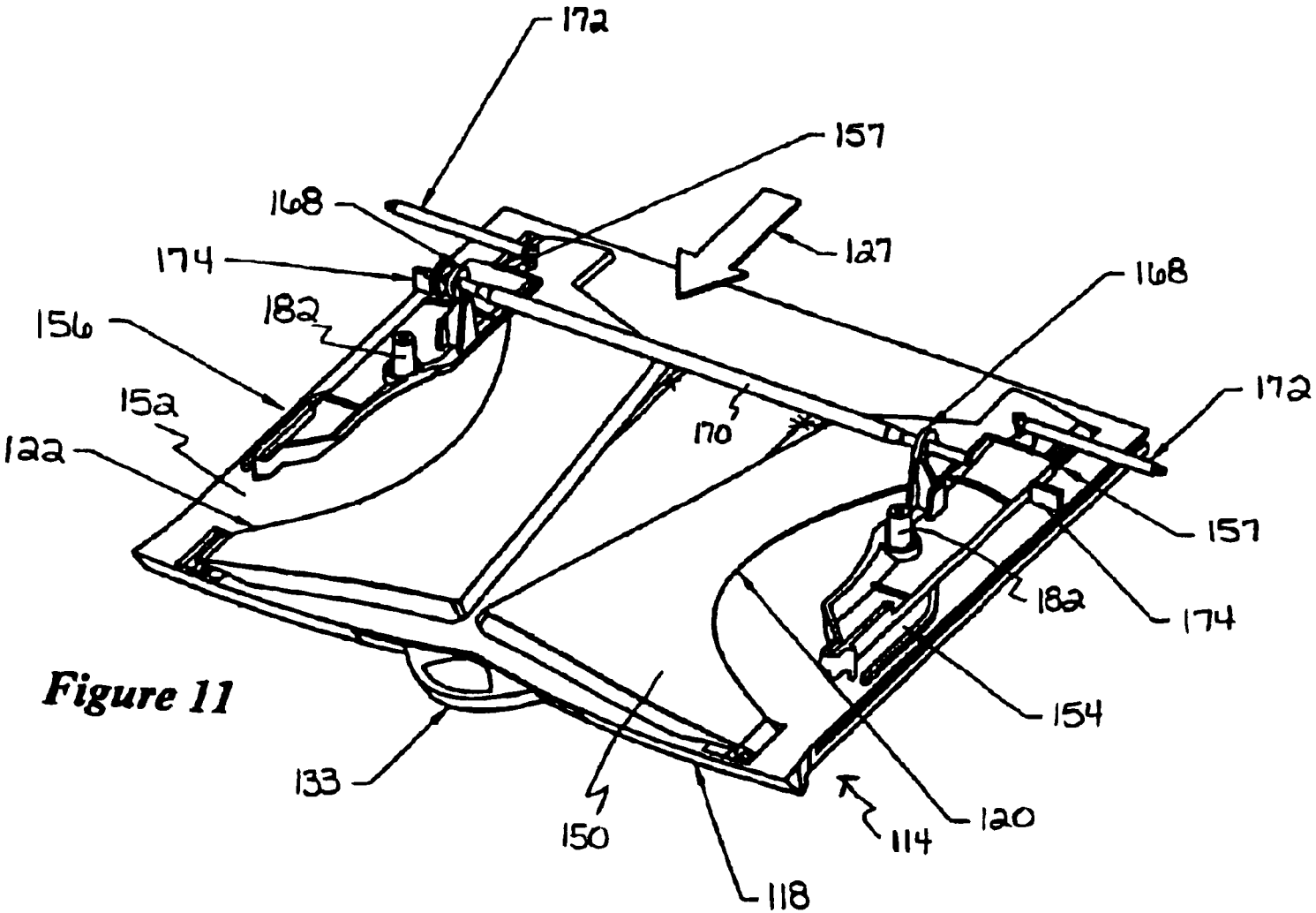
FIG. 11 is a perspective view of the exit tray assembly of FIG. 7 in the collapsed position.
Figure 12:
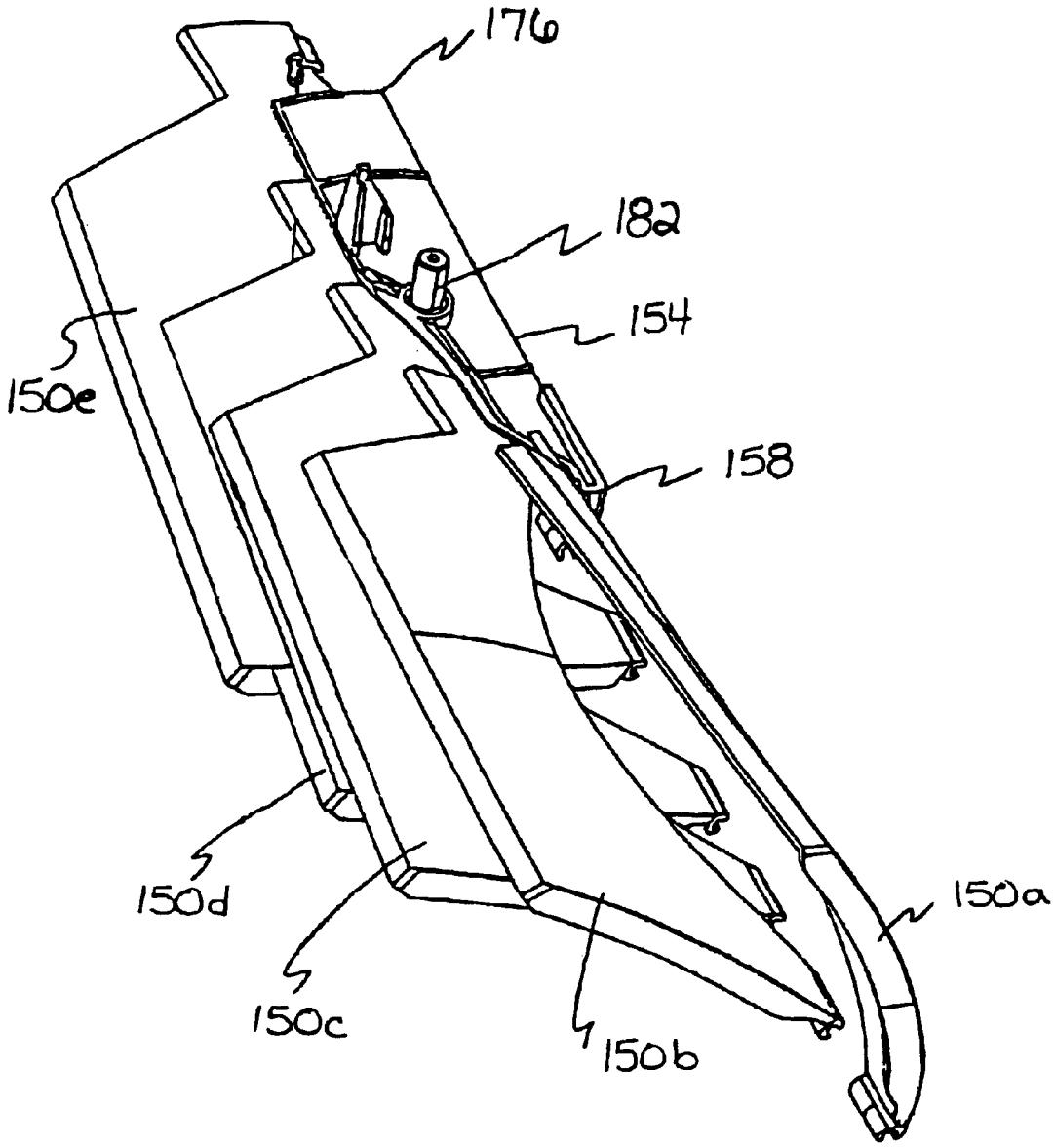
FIG. 12 is an operational perspective view of five positions of a support being collapsed inward when the exit tray (not shown) of FIG. 7 is slid from the exit tray use position to the exit tray collapsed position.

In an additional example, the computer printer 110 also includes a pair of arms 154 and 156 pivotally mounted to the housing 112, extending out from the housing 112 and each arm 154 and 156 having a distal end portion 158 positioned adjacent to an outer surface of a respective wing 150 and 152. Each wing 150 and 152 is biased outwardly (such as with torsion springs 157) to abut the respective arm's distal end portion 158. Each arm's distal end portion 158 is biased inwardly to position the respective wing 150 and 152 in the support position (seen in FIG. 8). Each arm's distal end portion 158 is outwardly pivotable by an actuator 160 to allow the respective wing 150 and 152 to pivot to the release position (seen in FIG. 9). Each wing 150 and 152 is pivotally coupled to the exit tray 118 at a lateral pivot point 162. Each arm 154 and 156 is spaced vertically above the exit tray 118. Each arm 154 and 156 includes an inner side (or cam) surface 164 that slopes inwardly from the distal end portion 158 beyond the lateral pivot point 162. As the exit tray 118 and attached wings 150 and 152 are slid to the collapsed position (seen in FIG. 11), the inner side surface 164 of each arm 154 and 156 abuts the respective wing 150 and 152 and causes the respective wing 150 and 152 to pivot to the folded position (seen in FIG. 11). FIG. 12 shows the arm 154 with its inner side surface 164 and shows five positions of the wing 150*a* through 150*e* as the exit tray (not shown in the figure) is slid to the collapsed position with wing 150*a* being in its use position as seen in FIG. 10 and with wing 150*e* being in its folded position as seen in FIG. 11.

In one construction, each actuator 160 includes a projection 166 and a cam 168. The projection 166 extends upwardly from the respective arm 154 and 156. The cam 168 is rotatable to contact the projection 166 and push the projection 166 in a direction that causes the distal end portion 158 of the arm 154 and 156 to pivot outwardly. Each cam 168 is mounted to a single cam shaft 170 running generally perpendicular to the arms 154 and 156.

In another construction, the computer printer 110 further includes a pair of springs 172. Each spring 172 is coupled between a respective arm 154 and 156 and the housing 112, wherein each spring 172 biases the respective arm's distal end portion 158 inwardly. The computer printer 110 additionally includes a pair of stops 174. Each stop 174 is coupled to the housing 112 and positioned adjacent to a proximal end portion 176 of a respective arm 154 and 156 on an outer side surface of the respective arm 154 and 156. Each stop 174 is operative to limit inward travel of the distal end portion 158 of the respective arm 154 and 156 against the respective wing 150 and 152 so that the respective arm 154 and 156 does not pivot the respective wing 150 and 152 inwardly beyond the respective wing's support position when the exit tray 118 is not in the collapsed position. In one example, the inward biasing of each arm 154 and 156 is stronger than the outward biasing of each wing 150 and 152.

In a second expression of the second embodiment, a printer exit tray assembly 114 includes a printed-sheet exit tray 118 and a pair of opposed sheet supports 120 and 122. The exit tray 118 is attachable to a printer housing 112. When the exit tray 118 is attached to the printer housing 112, the exit tray 118 is movable between a use position and a collapsed position. The exit tray 118 is disposed generally horizontally in the use position. The exit tray 118 projects horizontally further from the printer housing 112 in the use position than in the collapsed position. The sheet supports 120 and 122 are attached to the exit tray 118. When the exit tray 118 is in the use position the supports 120 and 122 are pivotable, with respect to the exit tray 118, between a support position for supporting a printed sheet 126 above the exit tray 118 and a release position for releasing the printed sheet 126 to the exit tray 118.

Another expression of the second embodiment is a combination computer printer 110 and active exit-tray support assembly 114 for the computer printer 110 and includes a printer housing 112, a generally horizontal exit tray 118, and a pair of opposed support wings 150 and 152, a pair of arms 154 and 156, at least one actuator 160, and a pair of opposed cam surfaces 164. The exit tray 118 is slidably coupled to the printer housing 112 and slidable to and away from the printer housing 112. The support wings 150 and 152 are pivotally coupled to the exit tray 118 on a longitudinal edge of each support wing 150 and 152 on a pivot axis 178 and 180 that runs generally parallel to a horizontal plane of the exit tray 118. The support wings 150 and 152 extend generally along opposite longitudinal sides of the exit tray 118. Each support wing 150 and 152 is pivotable from a generally vertical printed page support position (seen in FIG. 8) to a generally outwardly angled printed page release position (seen in FIG. 9). The arms 154 and 156 are pivotally mounted to the printer housing 112, on a pivot pin 182 generally perpendicular to the pivot axes 178 and 180 of the support wings 150 and 152. The arms 154 and 156 extend out from the housing 112, and each arm 154 and 156 has a distal end portion 158 abutting an outer side surface of a respective support wing 150 and 152, the wings 150 and 152 being biased outwardly against the respective arms 154 and 156. The at-least-one actuator 160 is operative to pivot the distal end portions 158 of the arms 154 and 156 outwardly, allowing the wings 150 and 152 to bias outwardly to the generally outwardly angled printed page release position, and inwardly again, pivoting the wings 150 and 152 back to the generally vertical printed page support position. The cam surfaces 164 are spaced above the exit tray 118. Each cam surface 164 has a leading edge positioned outside of the respective outer side surface of a respective support wing 150 and 152, and each cam surface 164 tapers inwardly with the distance towards the printer housing 112, whereby as the exit tray 118 is slid towards the printer housing 112, the inwardly tapering cam surfaces 164 contact the respective outer side surfaces of the respective support wings 150 and 152 and cause the support wings 150 and 152 to pivot inwardly to a folded position. In one example, each of the pair of opposed cam surfaces 164 is provided on a respective one of the arms 154 and 156.

Several benefits and advantages are derived from the invention. The supports hold a printed page or printed sheet above the exit tray to allow time for the ink to dry on the previously printed page or sheet lying on top in the exit tray. The collapsible exit tray assembly, or at least the collapsible exit tray portion thereof, frees up valuable desk space when the exit tray assembly is not in use and reduces packaging requirements for shipping.

The foregoing description of several expressions of several embodiments of the invention has been presented for purposes of illustration. It is not intended to be exhaustive or to limit the invention to the precise methods disclosed, and obviously many modifications and variations are possible in light of the above teaching. It is intended that the scope of the invention be defined by the claims appended hereto.

What is claimed is:

1. A computer printer comprising: a housing, having a generally horizontal printed paper outlet; and a printed paper exit tray assembly positioned adjacent to the paper outlet of the housing;

the printed paper exit tray assembly including a generally horizontal exit tray positioned below the paper outlet and a pair of opposed pivotable sheet supports positioned vertically between the paper outlet and the exit tray and extending generally along longitudinal sides of the exit tray, the supports adapted to being pivoted by an actuator, which is not a printed sheet or sheets, from a support position in which an upper support surface of each support is positioned directly below a respective horizontal end portion of the paper outlet to a release position in which the upper support surface of each support is pivoted outwardly away from the respective horizontal end portion of the paper outlet, such that the supports are operative in their support position to support printed sheets emitted from the paper outlet above the exit tray and operative in their release position to drop the printed sheets to the exit tray; and the printed paper exit tray assembly being collapsible with respect to the housing.

2. The computer printer of claim 1, wherein the exit tray is slidably mounted to a lower surface of the housing and is slidable to a collapsed position wherein the exit tray resides at least partially under the housing.

3. The computer printer of claim 1, wherein the exit tray is pivotably coupled to the housing, whereby the printed paper exit tray assembly collapses with respect to the housing by pivoting at least the exit tray up to a generally vertical orientation adjacent the housing.

4. The computer printer of claim 3, wherein:

each of the supports are actuated by a respective cam carried on a cam shaft;

the cam shaft further includes an actuator projection extending radially therefrom; and the actuator projection is acted upon by a reciprocating arm extending from the housing, wherein an outward extension of the reciprocating arm contacts and presses against a radially outer portion of the actuator projection, causing the cain shaft and cams to rotate, and, in turn, causing the cams to actuate their respective supports.

5. The computer printer of claim 4, wherein the reciprocating arm is a rack engaged with a pinion coupled to the housing.

6. The computer printer of claim 5, further comprising a pair of stops, respectively stopping the forward and rearward travel of the reciprocating arm at respective actuating and refracted positions, respectively.

7. The computer printer of claim 6, further comprising a clutch operatively coupled between the pinion engaged with the rack and a drive for rotatably driving the pinion.

8. The computer printer of claim 7, wherein the drive for rotatably driving the pinion is a drive gear, and the clutch is a friction clutch coaxially pressed between the pinion and the drive gear.

9. A combination computer printer and active exit-tray support assembly for the computer printer comprising:

a printer housing;

a generally horizontal exit tray coupled to the housing and pivotal between a generally horizontal orientation projecting away from the housing and a generally vertical orientation adjacent the housing;

a pair of opposed support wings pivotally coupled to the exit tray on a longitudinal edge of each support wing on a pivot axis that runs generally parallel to a horizontal plane of the exit tray and extending generally along opposite longitudinal sides of the exit tray, each being pivotable from a generally vertical printed page support position to a generally outwardly angled printed page release position;

each of the support wings actuated by a respective cam carried on a cam shaft;

the cam shaft further includes an actuator projection extending radially therefrom; and the actuator projection is acted upon by a reciprocating arm extending from the housing, wherein an outward extension of the reciprocating arm contacts and presses against a radially outer portion of the actuator projection, causing the cam shaft and cams to rotate, and, in turn, causing the cams to actuate their respective support wings.

10. The computer printer of claim 9, wherein the reciprocating arm is a rack engaged with a pinion coupled to the printer housing.

11. A printer exit tray assembly comprising:

a printed-sheet exit tray attachable to a printer housing, wherein, when the exit tray is attached to the printer housing, the exit tray is movable between a use position and a collapsed position, wherein the exit tray is disposed generally horizontally in the use position, and wherein the exit tray projects horizontally further from the printer housing in the use position than in the collapsed position; and a pair of opposed sheet supports attached to the exit tray, wherein the supports are adapted to being pivoted with respect to the exit tray, when the exit tray is in the use position, by an actuator, which is not a printed sheet or sheets, between a support position for supporting a printed sheet above the exit tray and a release position for releasing the printed sheet to the exit tray.

12. A computer printer comprising:

a) a housing, having a generally horizontal printed paper outlet;

b) a printed paper exit tray assembly positioned adjacent to the paper outlet of the housing, wherein the printed paper exit tray assembly includes a generally horizontal exit tray positioned below the paper outlet and a pair of opposed pivotable sheet supports positioned vertically between the paper outlet and the exit tray and extending generally along longitudinal sides of the exit tray, the supports being pivotable from a support position in which an upper support surface of each support is positioned directly below a respective horizontal end portion of the paper outlet to a release position in which the upper support surface of each support is pivoted outwardly away from the respective horizontal end portion of the paper outlet, such that the supports are operative in their support position to support printed sheets emitted from the paper outlet above the exit tray and operative in their release position to drop the printed sheets to the exit tray, and wherein the printed paper exit tray assembly is collapsible with respect to the housing; and c) at least one actuator operatively connected to the supports to pivot the supports to support and release only one printed sheet at a time.

* * * * *